US006564126B1

(12) United States Patent
Lin et al.

(10) Patent No.: US 6,564,126 B1
(45) Date of Patent: May 13, 2003

(54) SYSTEM FOR AUTOMATICALLY RESETTING AN OIL CONDITION ALARM LIGHT AFTER AN OIL CHANGE

(75) Inventors: Yingjie Lin, El Paso, TX (US); Carlos A. Buelna, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/567,907

(22) Filed: May 10, 2000

(51) Int. Cl.[7] ..... G01M 17/10; G06F 19/00; G06F 7/00

(52) U.S. Cl. ..... 701/30; 701/29; 701/123; 700/80; 700/281; 340/438; 340/439; 340/450; 340/457

(58) Field of Search ..... 700/281, 12, 13, 700/19–20, 274–275, 26, 27, 29–30, 31, 32, 80, 81, 69; 701/41, 29–30, 111, 123; 340/457, 450, 647, 438, 439, 457.4; 192/3.37; 324/551, 541; 477/176, 169, 906

(56) References Cited

U.S. PATENT DOCUMENTS 4,502,439 A * 3/1985 Nagase et al. ..... 123/357
4,550,261 A * 10/1985 Hormel et al. ..... 307/118
4,694,793 A * 9/1987 Kawakita et al. ..... 123/196 S
4,745,895 A * 5/1988 Seilenbinder et al. .... 123/196 S
4,796,204 A * 1/1989 Inoue ..... 123/196 S
4,884,054 A * 11/1989 Moon, Sr. ..... 340/309.15
5,159,313 A * 10/1992 Kawai et al. ..... 123/196 S
5,232,406 A * 8/1993 Sato ..... 474/18
5,331,287 A * 7/1994 Yamagishi et al. ..... 324/724
5,530,647 A * 6/1996 Sem et al. ..... 701/30
5,687,687 A * 11/1997 Trueblood et al. ..... 123/196 S
5,762,159 A * 6/1998 Matsuoka et al. ..... 180/417
5,934,241 A * 8/1999 Von Esebeck et al. .. 123/196 R
5,939,794 A * 8/1999 Sakai et al. ..... 290/40 A
6,104,185 A * 8/2000 Lamm et al. ..... 324/207.12
6,131,539 A * 10/2000 Thomas ..... 123/196 S
6,172,602 B1 * 1/2001 Hasfjord ..... 340/438
6,219,598 B1 * 4/2001 Miwa et al. ..... 340/438
6,253,601 B1 * 7/2001 Wang et al. ..... 340/438
6,275,765 B1 * 8/2001 Divljakovic et al. ..... 701/102
6,285,947 B1 * 9/2001 Divljakovic et al. ..... 701/110

* cited by examiner

*Primary Examiner*—Ramesh Patel
(74) *Attorney, Agent, or Firm*—Margaret A. Dobrowitsky

(57) ABSTRACT

A system for automatically resetting an oil condition alarm light after an oil change includes an in-vehicle digital processing apparatus electrically coupled to a warning lamp and to an oil sensor installed in an engine oil pan. The digital processing apparatus further includes a warning lamp reset module to automatically reset the oil sensor following an oil change, based on an oil parameter difference value.

16 Claims, 2 Drawing Sheets

LEVEL CONDITION

SYSTEM FOR AUTOMATICALLY RESETTING AN OIL CONDITION ALARM LIGHT AFTER AN OIL CHANGE

TECHNICAL FIELD

The present invention relates generally to systems and methods for automatically determining when oil in a motor vehicle has been changed.

BACKGROUND OF THE INVENTION

Sensors have been provided which automatically monitor the quality of oil in a motor vehicle to alert drivers in a timely fashion when maintenance should be performed as dictated by the actual condition of the oil. As the condition of the oil deteriorates, an oil condition sensor can send a signal to the vehicle instrumentation control to illuminate an in-dash warning light that may read, "Change Oil Soon." As the condition of the oil reaches a predetermined critical threshold, another light, such as "Change Oil Now," can be illuminated.

After the oil is changed, these sensors, and the corresponding warning lights, must be reset. The present invention recognizes that these sensors are typically reset by hand. However, the present invention understands that a technician might forget to reset the warning lights.

The present invention has recognized these prior art drawbacks, and has provided the below-disclosed solutions to one or more of the prior art deficiencies. More specifically, the present invention provides a method for determining when the oil in an engine has been changed and automatically resetting the oil condition sensor thereafter.

SUMMARY OF THE INVENTION

A computer-implemented method for automatically resetting an oil alarm lamp after an oil change in a vehicle includes receiving a current signal representative of at least one current oil parameter value from a sensor that is associated with an oil alarm light, comparing the current value to a prestored value, and based on the comparing act, selectively resetting the lamp.

In a presently preferred embodiment, the sensor is a level sensor, the prestored value is a prestored oil level value, the current value is a current oil level value, and the method further includes periodically energizing the sensor to obtain the current oil level value. Moreover, in a preferred embodiment, the comparing act produces a difference value, and the method further includes determining whether the difference value is greater than a difference threshold, and when the difference value is greater than the difference threshold, determining whether the current oil level value indicates empty. If the currently oil level indicates empty, the lamp is reset. Otherwise, the prestored oil level value is set equal to the current oil level.

In another embodiment, the sensor generates at least one signal representative of an oil parameter value other than level. The oil parameter value establishes the current value. The oil parameter value more preferably represents both a current oil impedance value and a current oil condition value, and the prestored value includes at least a prestored oil condition value and a prestored oil impedance value. The comparing act is undertaken by adding an impedance difference value representative of the difference between the prestored oil impedance value and the current oil impedance value to a condition difference value representative of the difference between the prestored oil condition value and the current oil condition value. In a preferred embodiment, the comparing act is undertaken only if a temperature of oil equals at least a threshold temperature.

In another aspect of the present invention, a computer program device includes a computer program storage device readable by a digital processing apparatus and a program means on the program storage device and including instructions executable by the digital processing apparatus for performing method acts for determining when an oil change has been undertaken on a vehicle. In this aspect of the present invention, the method acts include comparing at least one current oil parameter value with a prestored oil parameter value and based on the comparing act, outputting a signal representative of whether oil has been changed in the vehicle.

The present invention will now be described, by way of example, with reference to the accompanying drawings, in which:

DESCRIPTION OF AN EMBODIMENT OF THE INVENTION

Figure 1:
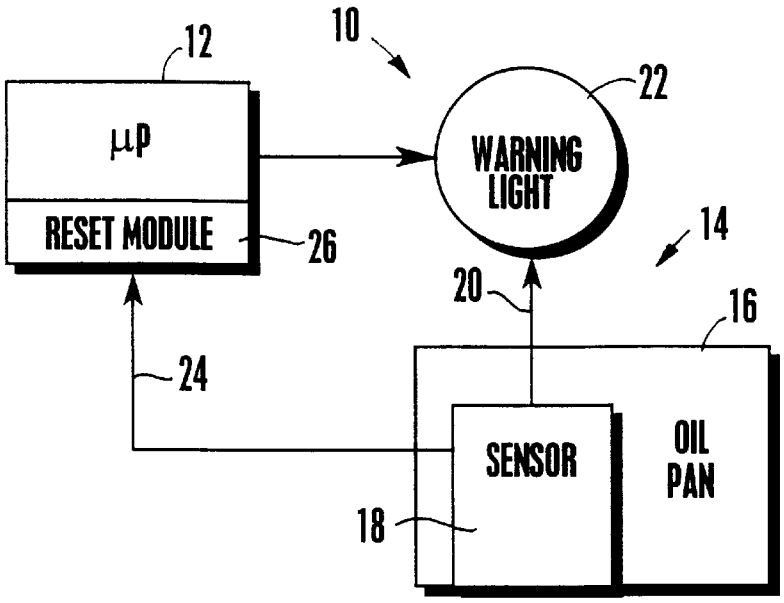
FIG. 1 is a block diagram of a system for automatically resetting an oil condition alarm light after an oil change.

Referring initially to FIG. 1, a system for automatically resetting an oil condition alarm light after an oil change is shown, generally designated 10. In the particular architecture shown, the system 10 includes a digital processing apparatus, such as a microprocessor 12. In one intended embodiment, the microprocessor 12 may be a chip that is mounted on a vehicle, generally designated 14, that includes an engine oil pan 16 and an oil sensor 18, such as a level sensor or an oil condition sensor. The sensor 18 generates a signal that can be sent via an electrical line 20 to one or more warning lamps 22 to energize the lamp 22 such that a driver viewing the lamp 22 is apprised of an adverse oil condition. Or, the sensor 18 can send a signal via an electrical line 24 to the microprocessor 12, which in turn can energize the lamp 22.

While the preferred implementation of the microprocessor 12 is an onboard chip such as a microcontroller or digital signal processor, it is to be understood that the logic disclosed below can be executed by other digital processors, such as by a personal computer made by International Business Machines Corporation (IBM) of Armonk, N.Y. Or, the microprocessor 12 may be any computer, including a Unix computer, or OS/2 server, or Windows NT server, or an IBM laptop computer.

The microprocessor 12 includes a warning lamp reset module 26 which may be executed by a processor within the microprocessor 12 as a series of computer-executable instructions. These instructions may reside, for example, in ROM of the microprocessor 12.

Alternatively, the instructions may be contained on a data storage device with a computer readable medium, such as a computer diskette. Or, the instructions may be stored on a DASD array, magnetic tape, EEPROM, conventional hard disk drive, electronic read-only memory, optical storage device, or other appropriate data storage device. In an illustrative embodiment of the invention, the computer-executable instructions may be lines of assembly code or any other high level computer language such as C, C++, Basic, etc.

The flow charts herein illustrate the structure of the logic of the present invention as embodied in computer program software. Those skilled in the art will appreciate that the flow charts illustrate the structures of computer program code elements including logic circuits on an integrated circuit, that function according to this invention. Manifestly, the invention is practiced in its essential embodiment by a machine component that renders the program code elements in a form that instructs a digital processing apparatus (that is, a computer) to perform a sequence of function steps corresponding to those shown.

Figure 2:
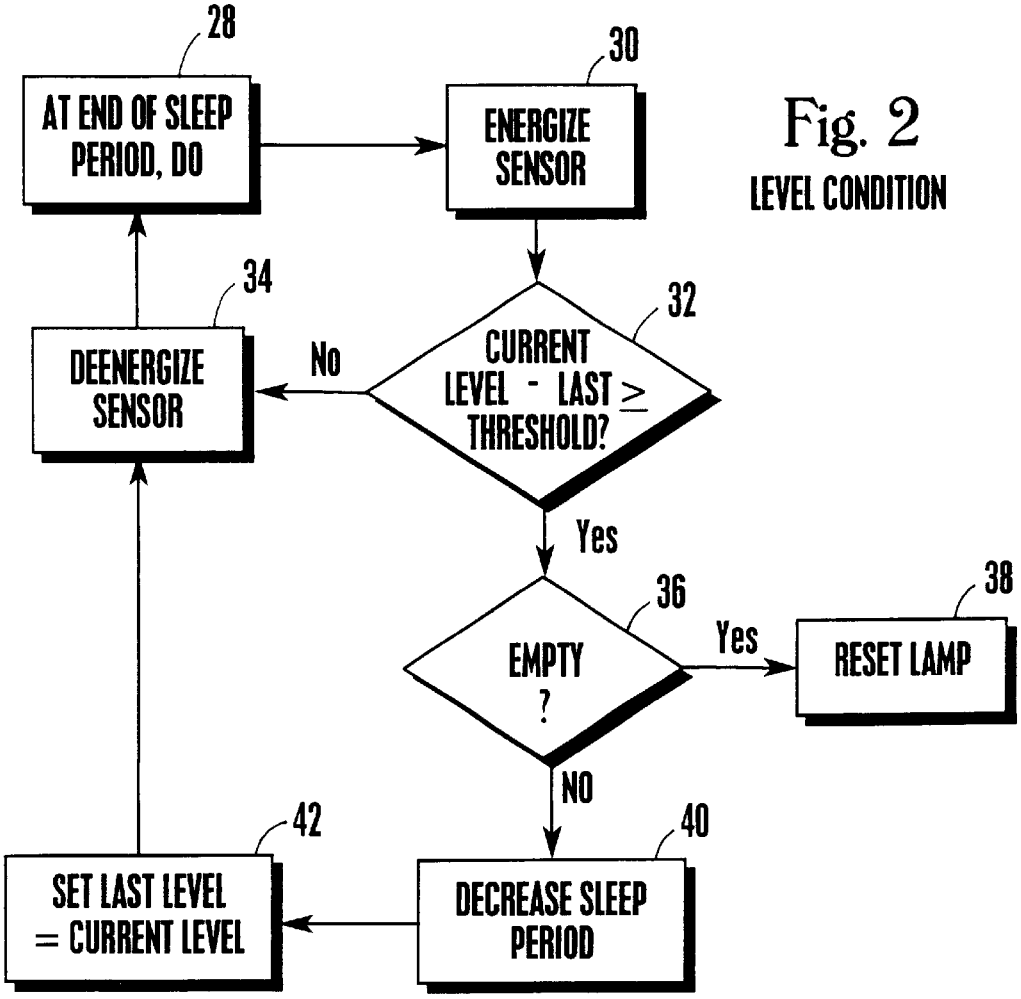
FIG. 2 is a flow chart representing a method for automatically detecting when engine oil is changed and resetting the oil sensor.

Now referring to FIG. 2, one embodiment of the logic of the reset module 26 can be seen, in which power is intermittently supplied to the sensor 18 when the sensor 18 is an oil level sensor. For example, the sensor 18 can be energized for a reading for about one second out of every thirty seconds or some other period, to conserve battery power. The period during which the sensor 18 is deenergized is referred to herein as the sleep period.

Commencing at block 28, a DO loop is entered when the sleep period expires. Moving to block 30, the sensor 18 is energized, and then at decision diamond 32 it is determined whether the difference between the currently measured oil level, as indicated by the signal from the sensor 18, and the last recorded level exceeds a threshold. The threshold, for example, can be a percentage such as ten per cent (10%). If the difference threshold is not exceeded, the logic moves from decision diamond 32 to block 34, wherein the sensor 18 is deenergized, i.e., the sensor 18 enters the sleep period at block 34. The logic then proceeds to block 28 to await the expiration of the sleep period.

If, on the other hand, the test at decision diamond 32 is positive, indicating a changed oil level, the process moves to decision diamond 36 to determine whether the signal from the sensor 18 indicates an empty oil level. If it does, the warning lamp 22 is reset at block 38. Otherwise, the logic moves from decision diamond 36 to block 40 to decrease the length of the sleep period by, e.g., one-half. From block 40, the logic moves to block 42 to record the new level, i.e., to set "last level=current level", and then the sensor 18 is deenergized at block 34. The logic then awaits the expiration of the sleep period at block 28 to execute as described above.

Figure 3:
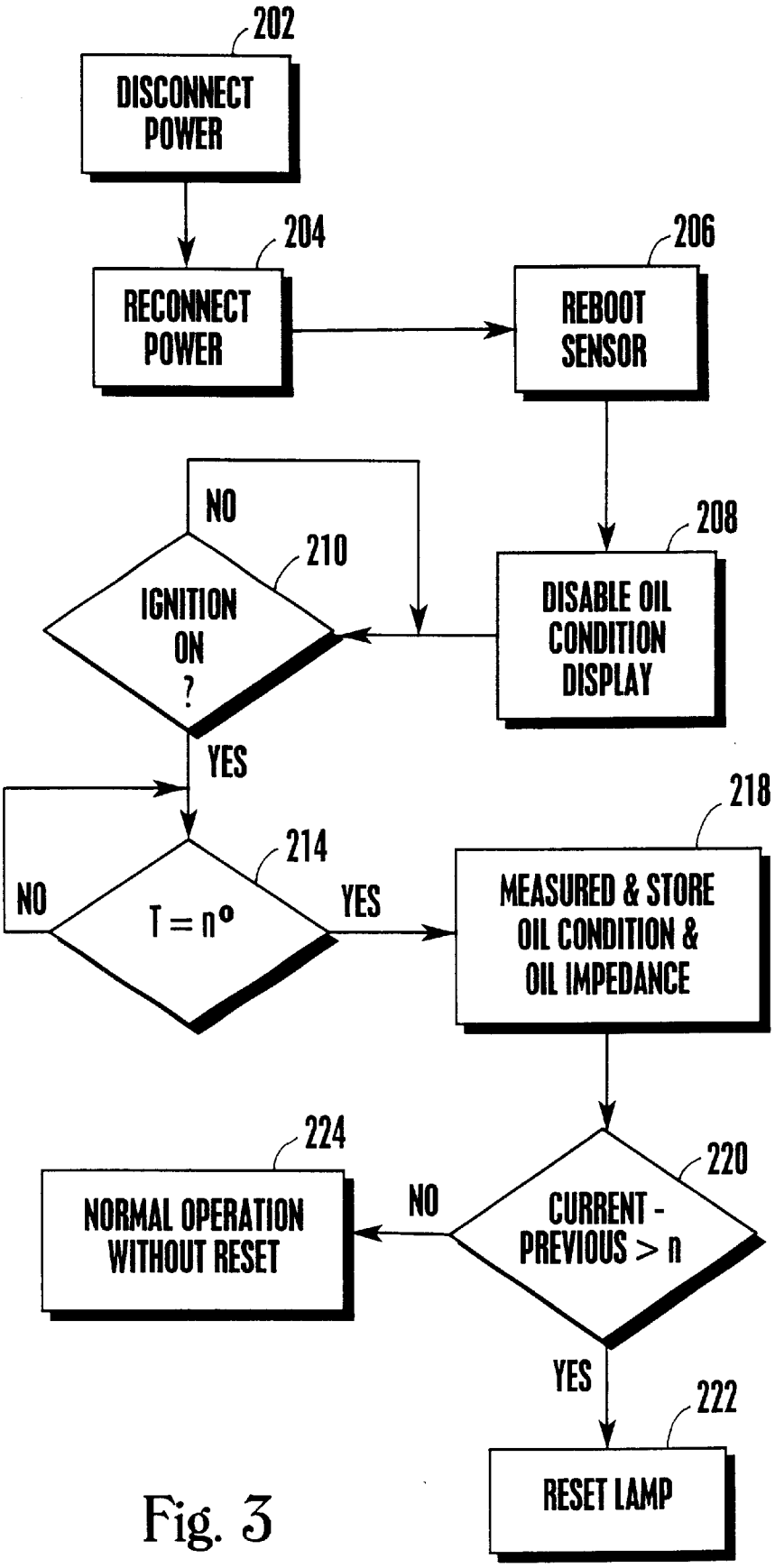
FIG. 3 is a flow chart of alternative method.

As understood herein, it might happen that, during oil change, power might be disconnected from the sensor 18, and that the sensor 18 consequently can not periodically be "awakened" for a reading. Under these circumstances, the sensor 18 can be a combined oil condition sensor/oil impedance sensor and the logic shown in FIG. 3 used. Or, two separate sensors can be equivalently used. In any case, commencing at block 202 the power to the sensor is disconnected. After oil change, the power is reconnected at block 204 and the sensor is rebooted at block 206. Once the sensor is rebooted, the oil condition display can be temporarily disabled at block 208.

From block 208 the logic flows to decision diamond 210 to determine whether the ignition of the vehicle 14 has been energized. If so, the logic continues to decision block 214 to determine whether the temperature of the oil has reached a predetermined value. Once the predetermined temperature is reached, the oil condition and oil impedance are measured and stored at block 218.

From block 218, the difference between the current oil condition and oil impedance and the previous oil condition and oil impedance that were stored in non-volatile memory or other data storage device with the capability to hold data in the absence of electrical power is determined at decision diamond 220 using the formula given below:

$$D=\alpha|V_{con_P}-V_{con_C}|+\beta|V_{imp_P}-V_{imp_C}|$$

where:

$V_{con_P}$=The previous oil condition signal at the predetermined oil temperature, $V_{con_C}$=The current oil condition signal at the predetermined oil temperature, $V_{imp_P}$=The previous oil impedance signal at the predetermined oil temperature, $V_{imp_C}$=The current oil impedance signal at the predetermined oil temperature, and $\alpha$, $\beta$=Weight factors.

If the difference value determined at decision diamond 220 is greater than a predetermined value, the sensor is reset at block 222. However, if the difference value is not greater than the predetermined value, the sensor is returned to normal operation mode at block 224 without resetting the lamp 22.

With the procedures described above, it is to be appreciated that the method for automatic detection of oil change of the present invention can be used to automatically reset an oil condition sensor or an oil level sensor following an oil change.

While the particular method for automatic detection of oil change as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A computer-implemented method for automatically resetting an oil alarm lamp after an oil change in a vehicle, the oil alarm lamp being associated with at least one sensor, the method comprising:

receiving a current signal from the sensor representative of at least one current oil parameter value;

comparing the current value to a prestored value; and based on the comparing act, selectively resetting the oil alarm lamp.

2. The method of claim 1, wherein the sensor is a level sensor, the prestored value is a prestored oil level value, the current value is a current oil level value, and the method further comprises:

periodically energizing the sensor to obtain the current oil level value.

3. The method of claim 2, wherein the comparing act produces a difference value, and the method further comprises:

determining whether the difference value is greater than a difference threshold;

when the difference value is greater than the difference threshold, determining whether the current oil level value indicates empty, and if so, resetting the lamp, otherwise setting the prestored oil level value equal to the current oil level value.

4. The method of claim 1, wherein the sensor generates at least one signal representative of an oil parameter value other than level, the oil parameter value establishing the current value.

5. The method of claim 4, wherein the oil parameter value represents at least one of oil condition, and oil impedance.

6. The method of claim 5, wherein the oil parameter value includes both a current oil impedance value and a current oil condition value, the prestored value includes at least a prestored oil condition value and a prestored oil impedance value, and the comparing act is undertaken by adding an impedance difference value representative of the difference between the prestored oil impedance value and the current oil impedance value to a condition difference value representative of the difference between the prestored oil condition value and the current oil condition value.

7. The method of claim 6, wherein the comparing act is undertaken only if a temperature of oil equals at least a threshold temperature.

8. A device comprising:

a computer program storage device readable by a digital processing apparatus; and a program means on the program storage device and including instructions executable by the digital processing apparatus for performing method acts for determining when an oil change has been undertaken on a vehicle, the method acts comprising:

comparing at least one current oil parameter value with a prestored oil parameter value; and based on the comparing act, outputting a signal representative of whether oil has been changed in the vehicle.

9. The computer program device of claim 8, wherein the method acts undertaken by the processing apparatus include:

receiving a current signal from at least one oil parameter sensor representative of the current oil parameter value; and based on the comparing act, selectively resetting an oil condition warning lamp associated with the sensor.

10. The computer program device of claim 9, wherein the sensor is a level sensor, the prestored oil parameter value is a prestored oil level value, the current oil parameter value is a current oil level value, and the method undertaken by the processing apparatus further comprises:

periodically energizing the sensor to obtain the current oil level value.

11. The computer program device of claim 10, wherein the comparing act produces a difference value, and the method undertaken by the processing apparatus further comprises:

determining whether the difference value is greater than a difference threshold;

when the difference value is greater than the difference threshold, determining whether the current oil level value indicates empty, and if so, resetting the lamp, otherwise setting the prestored oil level value equal to the current oil level value.

12. The computer program device of claim 9, wherein the sensor generates at least one signal representative of an oil parameter value other than level, the oil parameter value establishing the current oil parameter value.

13. The computer program device of claim 12, wherein the current oil parameter value represents at least one of: oil condition, and oil impedance.

14. The computer program device of claim 13, wherein the current oil parameter value represents both a current oil impedance value and a current oil condition value, the prestored oil parameter value includes at least a prestored oil condition value and a prestored oil impedance value, and the comparing act is undertaken by adding an impedance difference value representative of the difference between the prestored oil impedance value and the current oil impedance value to a condition difference value representative of the difference between the prestored oil condition value and the current oil condition value.

15. The computer program device of claim 14, wherein the comparing act is undertaken only if a temperature of oil equals at least a threshold temperature.

16. The computer program device of claim 14, wherein the method acts further comprise:

holding data useful in the comparing act in storage when electrical power to the storage is absent.

* * * * *